US005784341A

United States Patent [19]

Sernit et al.

[11] Patent Number: 5,784,341

[45] Date of Patent: Jul. 21, 1998

[54] UNDERWATER ACOUSTIC TRANSMITTER FOR LARGE SUBMERSION

[75] Inventors: Eric Sernit, Mouans-Sartoux; Bernard Fromont, Plateau de Roquebilléne Bendejun; Pascal Bocquillon, Vallauris; Josette Adda, Valbonne, all of France

[73] Assignee: Thomson-CSF, Paris, France

[21] Appl. No.: 817,092

[22] PCT Filed: Oct. 13, 1995

[86] PCT No.: PCT/FR95/01350

§ 371 Date: Apr. 14, 1997

§ 102(e) Date: Apr. 14, 1997

[87] PCT Pub. No.: WO96/11752

PCT Pub. Date: Apr. 25, 1996

[30] Foreign Application Priority Data

Oct. 14, 1994 [FR] France ..... 94 12285

[51] Int. Cl.[6] ..... H04R 17/00

[52] U.S. Cl. ..... 367/155; 367/159; 367/167; 367/172; 310/337

[58] Field of Search ..... 367/153, 155, 367/159, 167, 172; 310/337

[56] References Cited

U.S. PATENT DOCUMENTS

| | | | |
|---|---|---|---|
| 3,890,591 | 6/1975 | Bocquillon et al. | 367/153 |
| 5,068,834 | 11/1991 | Fromont | 367/135 |
| 5,099,457 | 3/1992 | Giannotta et al. | 367/131 |
| 5,517,467 | 5/1996 | Fromont et al. | 367/155 |

*Primary Examiner*—J. Woodrow Eldred
*Attorney, Agent, or Firm*—Oblon, Spivak, McClelland, Maier & Neustadt, P.C.

[57] ABSTRACT

The invention relates to underwater acoustic transmitters intended to be submerged at large depths. It consists in threading the set of annuli forming the transmitter onto an internal tube (303) preferably made from a carbon/resin composite, which supports two end plugs (306, 307) making it possible to relieve the set of annuli of the radial component of the hydrostatic pressure. Furthermore, between the piezoelectric annuli (101) of the transmitter are inserted decoupling annuli (301) which are made as a three-layer structure including a hard and rigid internal layer (201) and two flexible and elastic external layers (202, 203). It makes it possible to increase the transmitting power of these acoustic transmitters.

4 Claims, 1 Drawing Sheet

UNDERWATER ACOUSTIC TRANSMITTER FOR LARGE SUBMERSION

Figure 1:
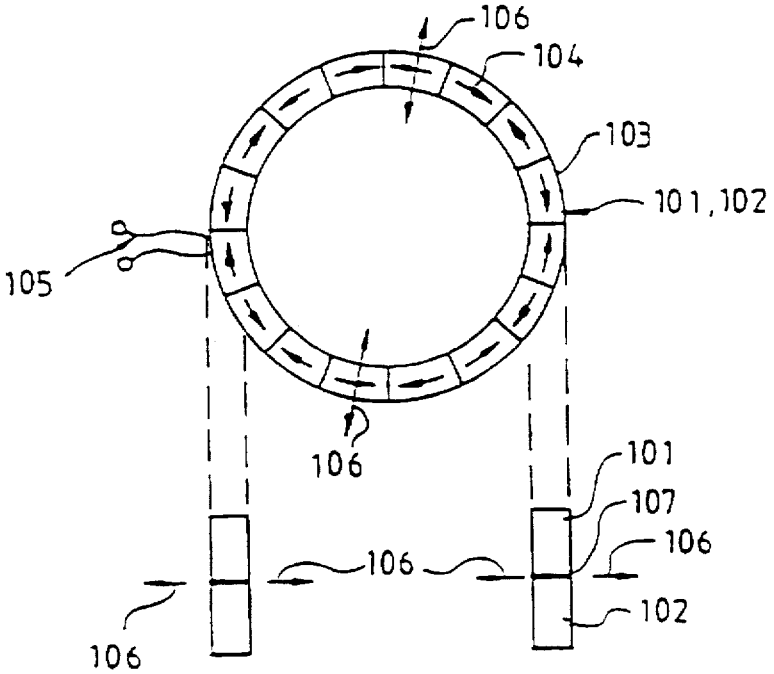

The present invention relates to underwater acoustic transmitters used at considerable submersions, capable of reaching 1000 m for example. These acoustic transmitters can be used to carry out underwater charting according to the art of sonars.

It is known to construct underwater acoustic transmitters which make it possible to obtain a transmission pattern which is omnidirectional in a plane, generally in bearing. To do this, use is made of a stack of annular piezoelectric ceramics which vibrate radially. To obtain good acoustic efficiency, the transmission frequency is fixed at substantially the resonant frequency of the annuli. Usual operational values are a diameter of around 20 cm for a transmission frequency of the order of 5 KHz.

For relatively small submersions, corresponding for example to those of a hull sonar, the hydrostatic water pressure has a negligible influence on the operation of such a transmitter.

There is known from the U.S. Pat. No. 3,444,508 an underwater acoustic receiver suspended by a cable from a buoy. This device does not make it possible to reach large submersions, by virtue of the limited length of the cable. It includes a support tube terminating in two plugs whose structure does not appear to be particularly adapted so as to be resistant to the effects of submersion at large depth. Furthermore, being a receiver, this device does not have to support large mechanical loads stemming from the acoustic waves, as is the case in a transmitter.

Also known from patent U.S. Pat. No. 5,099,460 is the use of seals to protect acoustic ceramic annuli from shocks.

When it is desired to undertake explorations at larger depths, by placing for example the transmitter in a fish towed at a considerable submersion, the influence of the hydrostatic pressure on this transmitter becomes greater and greater and ultimately excessively disturbs the operation thereof. This may even in certain cases involve damage to, or even destruction of the transmitter by virtue of the superposition of the hydrostatic stresses and dynamic stresses stemming from the vibration required for transmission of the acoustic wave. Thus, to obtain adequate acoustic transmission power, the piezoelectric ceramic needs to be loaded by a considerable electric field which gives rise to internal stresses which may be very high, to the point of causing fractures of the ceramic, this making it necessary therefore to limit the power radiated.

At large depth, the ceramic annuli of diameter R and thickness e are subjected to a hydrostatic pressure whose radial component generates in the ceramic a stress which is itself amplified by a factor R/e. By way of example this amplification factor is of the order of 10 for a depth of 1000 m and hence a stress of radial origin of the order of 1000 bar is obtained.

Furthermore, the axial force due to the hydrostatic pressure on the ends of the transmitter reaches a value of 300,000 newtons (30 tonnes) for a depth of 1000 m and a 20 cm diameter transmitter. This force applied to the rim of the ceramic annuli gives rise to a further additional stress of the order of 600,000 hectopascals (600 bar). Apart from the risks of fracture, the resultant of these two additional stresses entails serious consequences by modifying the piezoelectric coefficients of the ceramics, resulting in a drifting of performance with regard to sound level and the impedances of the antenna. This drifting exhibits at least partially an irreversible character which may become aggravated in the course of successive submersions. Compensation of all these effects is if not impossible at the very least difficult and expensive to implement.

Furthermore, for well-known strictly acoustic reasons, there is benefit in mutually mechanically decoupling the ceramic annuli stacked one above the other to form the antenna in such a way as to be able to obtain the desired performance with regard to the transmission pattern of the acoustic transmitter. Such mechanical decoupling between the ceramic annuli, by means usually employed, is rendered impossible by forces as considerable as those mentioned above due to deep submersions.

To alleviate these drawbacks, the invention proposes an underwater acoustic transmitter according to the appended claims.

Figure 2:
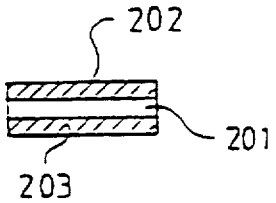
Figure 4:
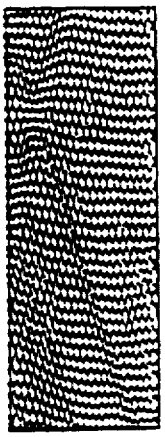
Figure 3:
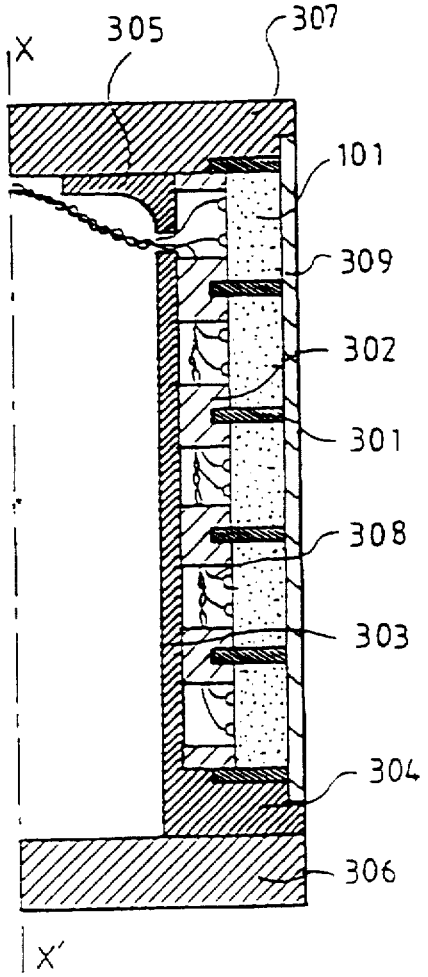

Other features and advantages of the invention will emerge clearly in the following description given by way of a non-limiting example with reference to the appended figures which represent:

FIG. 1, a plan view and sectional side elevation of two piezoelectric annuli separated by a coupling annulus;

FIG. 2, a sectional view of the decoupling annulus of FIG. 1;

FIG. 3, a vertical sectional view of a transmitter according to the invention; and FIG. 4, a sectional view of a part of the internal tube of the transmitter of FIG. 3.

The two piezoelectric ceramic annuli 101 and 102 represented in FIG. 1 are formed in this embodiment by segments 103 alternately polarized in one direction and in the opposite direction around the circumference of the annuli. These polarizations are represented by the arrows 104. Included between these segments are radial electrodes which are fed via leads 105 in such a way as to make them contract and expand as a function of the signals applied by these leads. Under these conditions, the annulus dilates and constricts radially in tempo with these signals. This radial movement is represented by the arrows 106.

In order to decouple the annulus 101 from the annulus 102, the invention proposes to separate these two annuli by an intermediate annulus 107, which in the case of the figure actually exhibits the form of a washer since its thickness in this embodiment is appreciably smaller than its width.

Such a decoupling annulus must exhibit relatively contradictory mechanical characteristics. Thus, it must resist the residual axial pressure so as not to be crushed excessively, this normally corresponding to a relatively considerable hardness (the residual character of this axial pressure will be explained later in the text). Moreover, it must exhibit a low impedance in shear in relation to the shear impedance of the ceramic annuli, so as to obtain effective decoupling, this normally corresponding to a relatively high elasticity, and hence to a rather low hardness.

To obtain these two results simultaneously, the invention proposes to construct the intermediate decoupling annuli s-as a three-layer structure represented in FIG. 2.

This three layer structure is formed from a hard and rigid internal layer 201 surrounded by two flexible and elastic external layers 202 and 203. In this way, the internal layer opposes crushing whilst the external layers allow relatively free play of the ceramic annuli with respect to one another.

This characteristic, which corresponds to a low impedance in shear, is obtained by acting on the characteristics (shear modulus, Poisson's ratio, losses) of the materials making up this annulus and on the dimensions (thickness, height, diameter) of the three layers. Bearing in mind the frequency band in which the transmitter is to operate, the characteristics of this intermediate annulus can be dynamically optimized by modelling it, in a manner known in the art, on a mass/spring principle in which the two external layers 202 and 203 act as springs affording the necessary compliance and the internal layer acts as mass affording the desired inertia.

In practice, and for the above-mentioned dimensions and frequencies, by using a central layer of polyethylene with a thickness of the order of one millimetre surrounded by two external layers of neoprene having substantially the same thickness, a result very close to the desired result is already obtained and this result can be refined by modifying the thicknesses experimentally. Optimization is achieved very rapidly after a few trials.

The ceramic annuli are then assembled with the other elements forming the structure of the transmitter so as to obtain a complete transmitter as represented in FIG. 3.

This transmitter therefore consists of a stack of piezoelectric ceramic annuli 101 separated by decoupling annuli 301. In the figure, these annuli have been represented in monobloc form for simplicity, whereas their structure is of course that of FIG. 2.

The internal diameter of these decoupling annuli is here smaller than the internal diameter of the ceramic annuli, this allowing them to be embedded in an external circular groove made in rubber centring annuli 302. The external diameter of these centring annuli is equal to the internal diameter of the ceramic annuli.

This assembly is then threaded onto an internal tube 303 whose external diameter is equal to the internal diameter of the centring annuli 302. Apart from this centring function, these annuli 302 also make it possible to decouple the vibration of the ceramic annuli with respect to the tube 303. This tube terminates at its base in an outside shoulder 304 on which rests the last decoupling annulus and the last centring annulus. The tube also terminates at the top in an inside shoulder 305.

The external shoulder 304 is then made to rest on a lower plug 306 constituting the base of the transmitter.

This assembly is subsequently closed by an upper plug 307 which constitutes the lid of the transmitter and which rests on the internal shoulder 305 and on the first upper decoupling annulus and the first upper centring annulus.

As and when the various annuli are assembled onto the internal tube 303, the leads 308 of the ceramic annuli are passed through holes made in the centring annuli. Together these leads pass back to the inside of the internal tube through a hole made therein. They subsequently emerge from the transmitter through a leaktight passage (not represented) made for example in the upper plug 307.

Assembly is completed by covering the outside face of the ceramic annuli and of the decoupling annuli with a sleeve 309 made from an acoustically transparent material, polyurethane for example.

According to the invention, the internal tube 303 supports the bulk of the loads due to the pressure which is exerted on the lower 306 and upper 307 plugs. The load applied by these plugs to the lower and upper end decoupling annuli and consequently to the set of ceramic annuli and other decoupling annuli is then considerably reduced and limited essentially to the prestress value obtained during assembly by using the tube 303 as a prestress rod for prestressing to a low value and controlled [sic] the stack of ceramics, so as to obtain acoustic characteristics which are reproducible in air and in water.

To do this it is necessary to use an internal tube 303 whose elastic coefficient is as low as possible and which does not exhibit too massive a form so as to avoid making the transmitter overheavy. This makes it possible furthermore to use a hollow tube whose inside volume can be used to house at least one part of the electronics for processing the signals applied to the ceramics.

To obtain these results, the invention proposes to construct this internal tube 303 from a composite material formed of wound fibres having a very small angle of inclination relative to the vertical axis of this tube, as represented diagrammatically in FIG. 4. These fibres will be immobilized inside a holding matrix. By way of example a carbon/resin type material will be used, the performance of which is known to be currently among the best available.

In the embodiment represented in FIG. 3, the ceramic annuli and the decoupling annuli are identical. As a variant, the invention proposes to use decoupling annuli whose height and possibly makeup can be varied from one to another so as to modify the decoupling between the ceramic annuli depending on their position in the transmitter. This modification of decoupling makes it possible to modify the radial displacement velocities of the ceramics, that is to say the relative amplitudes of transmission of the acoustic waves of the annuli with respect to one another. A radial velocity profile is thus obtained over the whole height which can be varied within wide limits. As is known, the shape of the radiation pattern of the transmitter depends largely on this velocity profile, in particular as regards the attenuation of side lobes. The profile thus obtained can therefore be adapted to the operational conditions under which it is desired to use the transmitter. It would also be possible to vary the height of the piezoelectric ceramic annuli, and this would give an additional degree of freedom to configure the transmitter.

We claim:

1. An underwater acoustic transmitter for large submersion, of the type comprising a set of piezoelectric annuli stacked to form a transmitter cylinder, which is threaded onto a tube supporting at its too ends plugs characterized in that the tube can resist the axial component of the hydrostatic pressure applied to the plug so as to protect the stack of annuli from the action of this axial component, and in that it furthermore comprises of set of decoupling annuli inserted respective between the piezoelectric annuli and the effectiveness of which stems from the axial stress reduction due to the resistant tube, wherein the decoupling annuli have a three-layer structure comprising a hard and rigid internal layer and too flexible and elastic external layers.

2. Transmitter according to claim 1, wherein the internal layer is made of polyethylene and the external layer of neoprene.

3. Transmitter according claim 1, wherein the thicknesses of the decoupling annuli differ from one another so as to obtain a weighting of the transmission of the piezoelectric annuli as a function of their location along the height of the antenna.

4. Transmitter according claim 2, wherein the internal tube is formed from a carbon/resin composite.

* * * * *